US007267311B2

(12) United States Patent
Jung

(10) Patent No.: US 7,267,311 B2
(45) Date of Patent: Sep. 11, 2007

(54) ROLLER BLIND FITTINGS

(75) Inventor: Claes Jung, Zug (CH)

(73) Assignee: Odin AG, Zug (CH)

( * ) Notice: Subject to any disclaimer, the term of this patent is extended or adjusted under 35 U.S.C. 154(b) by 55 days.

(21) Appl. No.: 10/544,459

(22) PCT Filed: Feb. 2, 2004

(86) PCT No.: PCT/SE2004/000134

§ 371 (c)(1),
(2), (4) Date: Aug. 3, 2005

(87) PCT Pub. No.: WO2004/070157

PCT Pub. Date: Aug. 19, 2004

(65) Prior Publication Data

US 2006/0049325 A1 Mar. 9, 2006

(30) Foreign Application Priority Data

Feb. 4, 2003 (SE) ..... 0300267

(51) Int. Cl.
*A47H 1/10* (2006.01)

(52) U.S. Cl. ..... 248/266; 160/903

(58) Field of Classification Search ..... 248/266, 248/267, 268, 251, 252, 254; 160/903
See application file for complete search history.

(56) References Cited

U.S. PATENT DOCUMENTS

| | | | | |
|---|---|---|---|---|
| 4,235,406 | A * | 11/1980 | Vecchiarelli | 248/251 |
| 4,411,401 | A * | 10/1983 | Anderson | 248/262 |
| 6,561,475 | B1 * | 5/2003 | Chuang | 248/264 |
| 7,017,644 | B1 * | 3/2006 | Kraeutler | 160/271 |

FOREIGN PATENT DOCUMENTS

| | | |
|---|---|---|
| WO | 415904 | 11/1980 |
| WO | 431246 | 1/1984 |

* cited by examiner

*Primary Examiner*—Ramon O Ramirez
(74) *Attorney, Agent, or Firm*—Ladas & Parry LLP

(57) ABSTRACT

The present invention relates to a bracket for a roller blind, for the fitting of a roller blind to a surface. The bracket comprises a clip (220, 260) and a base part (200, 240), the said clip and the said base part being of a design that permits them to be assembled and disassembled without the use of tools, and when assembled prevents them from coming apart, by means of snap lock mechanism.

19 Claims, 6 Drawing Sheets

PRIOR ART

ROLLER BLIND FITTINGS

FIELD OF INVENTION

The present invention relates to roller blinds, in particular to fittings for roller blinds.

PRIOR ART

To function, a roller blind needs two points of suspension, one at each end of the roller. At least one of the points of suspension must be able to withstand and counteract not only the weight of the roller and the fabric, but also the torque created by a drive, spring, or brake mechanism.

One solution according to prior art comprises two fittings, usually made of sheet metal or plastics, one bracket being provided with a hole for a cylindrical journal pin, rigidly attached to the external face of the roller, and the other with a slot, one end of which opens towards the periphery of the bracket. The roller is fitted between these fittings by first entering the cylindrical journal pin into the round hole of the first bracket, and then entering a torque-transmitting roller pin, typically flat, connected with the spring mechanism of the blind, into the corresponding slot in the second bracket (see FIG. 1).

This prior art solution usually gives rise to a certain play between the torque-transmitting flat roller pin and the bracket, resulting in a risk of instability and excessive loads on bracket and blind, as well as increased wear. One problem with prior art solutions comprising fittings in one piece is that the torque-transmitting roller pin must be flat, its flatness permitting it to be entered sideways into the slot of the bracket, and also ensuring transmission of torque during the operation of the blind. The roller needs to be fitted to prior art fittings of this kind from above, to prevent the roller from falling out of the bracket during use. To enable fitting from above there must be some free space above the bracket, which is not always the case. With the prior art fittings there is also a risk of poor attachment to the wall, since the wall sections directly behind the fittings are not always suited for attaching screws. Thus, there is a need in the marketplace for a stable and safe bracket, which also enables a simple, quick and effortless fitting of the blind.

SUMMARY OF THE INVENTION

The present invention relates to a set of roller blind fittings, comprising a first and a second roller blind bracket, wherein at least one of the said fittings comprises a clip, provided with a receptacle for the pin of a roller, and a base part, provided with means for attaching the said base part directly or indirectly to a surface, said clip and said base part being designed to allow disassembly and assembly and comprising an assembly mechanism that allows the clip to be fitted to the base part to form an assembled unit. Preferably, the base part is also provided with means, such as holes for screws or a slot for a rail, to enable attachment of the base part to a supporting element, for example a wall, a ceiling or a recessed surface.

The invention also relates to the corresponding clip and base part as separate devices. It is within the scope of the invention to attach a first clip to the torque-transmitting roller pin and a second clip to the cylindrical journal pin. The roller blind can then be fitted to a first and a second base part, these base parts having been attached beforehand to the surface that supports the blind.

The receptacles of the clips are preferably adapted to the respective sizes of the roller pins, to establish a suitable fit between each receptacle and its corresponding roller pin. According to different embodiments of the invention, the receptacle for the torque-transmitting roller pin is adapted to receive a pin that is flat, cross-shaped, hexagonal, square, splined or of any other suitable shape.

During assembly, the assembly procedure is simplified by the fact that the clip and its corresponding base part may be assembled and disassembled without the use of tools.

A preferred method of fitting a roller blind according to the invention comprises: entering the first roller pin into its corresponding bracket, which is already attached to the mounting surface, fitting a clip to the other roller pin, and snapping this clip with the fitted roller pin into its corresponding base part.

According to a particularly cost-effective embodiment only one of the fittings can be disassembled and assembled, the other one being manufactured in one piece, this alternative being less costly both at the manufacturing stage and the distribution stage.

BRIEF DESCRIPTION OF THE DRAWINGS

To describe the invention in greater detail and present its benefits and features, a preferred embodiment will be described below, with reference to the enclosed drawings, of which.

DETAILED DESCRIPTION OF THE INVENTION

The following description is based on the assumption that the roller blind is mounted in fittings with one roller end journaled and the other end being able to transmit a torque. It is fully within the scope of the invention, however, to provide the roller with two torque-transmitting ends, for example with one end spring-loaded and the other equipped with an auxiliary spring or a brake mechanism, which is particularly useful in connection with large roller blinds.

Figure 1:
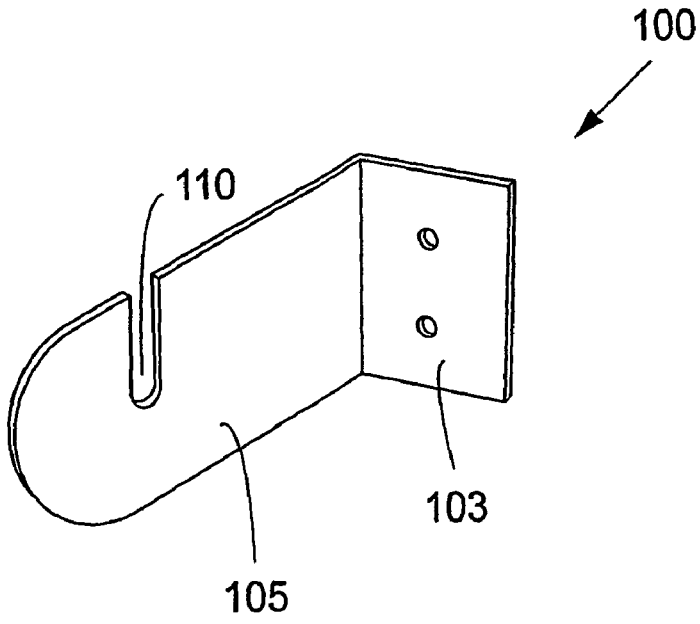
FIG. 1 shows a set of roller blind fittings according to the prior art.
Figure 1:
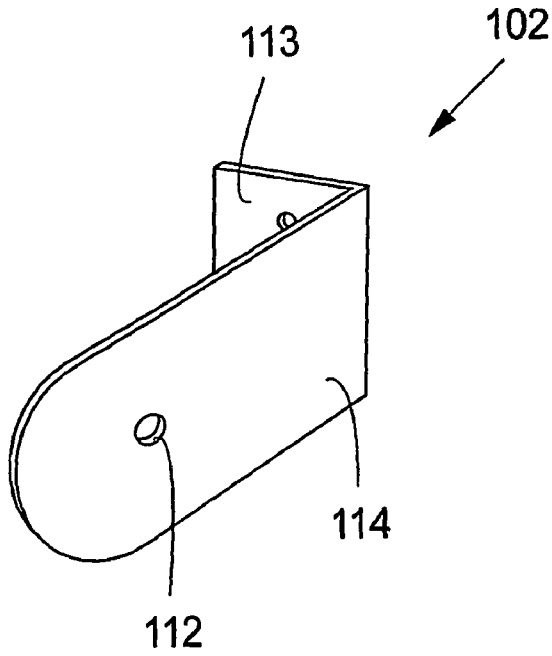

FIG. 1 shows a set of roller blind fittings according to the prior art. Both fittings 100, 102 comprise an angled cantilever part 100, 102, usually made of sheet metal, consisting of an inner part 103, 113, bearing against the wall, and an outer extended part 105, 114. The outer extended part 105, 114 also provides the receptacles 110, 112.

The bracket intended to receive the torque-transmitting roller pin is provided with a receptacle comprising an elongated slot 110, into which the torque-transmitting pin fits. The bracket that receives the cylindrical journal pin of the roller is provided with a round hole 112, into which the said cylindrical journal pin fits.

The fitting of a blind typically comprises mounting the fittings to the surface, which is part of the wall, the ceiling or a recess, near the window which is to be shaded, fitting the blind to the fittings by entering the cylindrical journal pin into the first bracket 102 and then slipping the torque-transmitting roller pin into the slot 110 of the second bracket 100. If the blind is to be fitted to a recess, the fittings must be given a slightly different design, however. It is not unusual that there is a play between the flat roller pin and the slot, the said play comprising a fraction of a millimeter. This play may cause instability and excessive wear. Since the slot is open upwards and the roller end is not fixed, there is a risk that the blind will jump out of the bracket, if handled carelessly.

These drawbacks are eliminated by the present invention, which is also well suited for being manufactured from plastics, resulting in a low cost of production.

Figure 2:
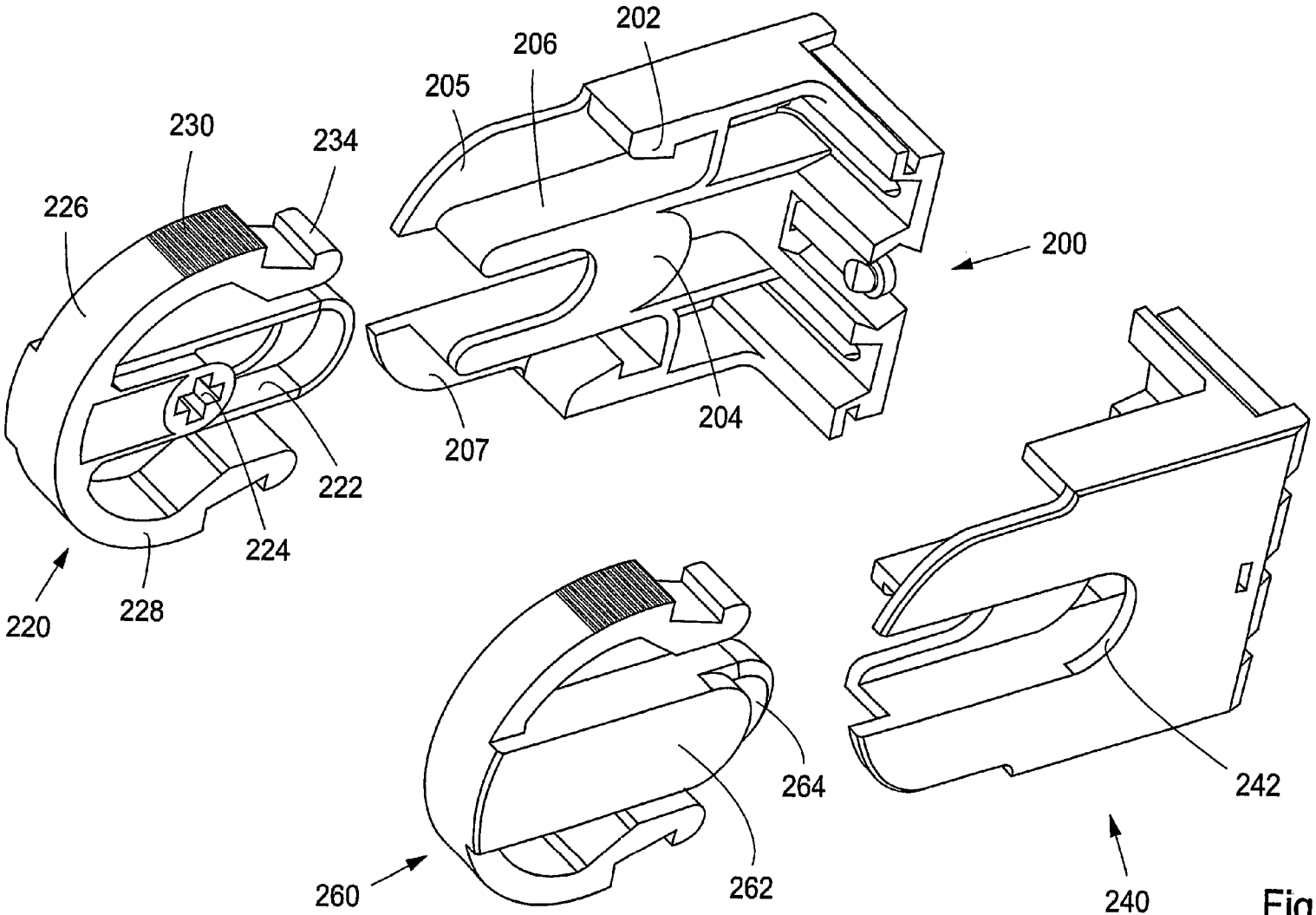
FIG. 2 shows roller blind fittings according to the invention, before assembly.

FIG. 2 shows roller blind fittings according to the invention, before assembly. As indicated above, a set of two fittings is needed for the fitting of a roller blind. The roller blind may be provided with a spring mechanism, a brake mechanism, a side-winding mechanism or an electric motor, or with some other mechanism that requires the roller ends of the blind to brace against a stationary structure outside the roller, so as to enable transmission of torque thereto. The fittings must be able to withstand these torques, as well as the forces exerted by a person pulling at a cord to operate the blind. According to a first embodiment, the set of fittings comprises a first bracket, adapted to receive the torque-transmitting roller pin, and a second bracket, adapted to receive the journal pin, which is typically cylindrical, but may be of some other shape. In the latter case, the bracket in question is designed to be able to receive a journal pin of such other shape. The two fittings according to the invention are generally of similar construction, and if nothing is said to the contrary, the description at hand is valid for both fittings.

The first bracket consists of a base part 200 and a clip 220. The clip 220 has a central body 222, which fits in a recess in the base part 200. The said central body 222 is provided with a receptacle 224, which is adapted to receive the torque-transmitting roller pin. This receptacle may be a cross-shaped hole, a straight slot, or some other recess that will receive a many-sided body suited for the transmission of torque. Further, the clip has two resilient arms 226, 228, extending from the central body. Both of these resilient arms are provided with a grip area 230, indicating the proper point of pressure for the least resistance during compression of the resilient arms with the fingers. Advantageously, the grip area 230 is provided with knurls or some other distinct markings, to indicate the proper place to apply pressure when compressing the resilient arms 226, 228. These markings also enhance the grip during compression, by increasing friction versus a smooth surface. At the far end of the resilient arms, a catch is provided, adapted to interact with a corresponding catch 202 in the base part 200, thereby forming a snap lock mechanism, which keeps the clip attached to the base part after assembly of the bracket.

To improve the stability and strength of the assembled bracket, supporting panels 204, 206, 242 have been provided to support the central body 222 of the clip and its nose section 264. To support and guide the resilient arms, supporting panels 205, 207 have been provided.

Figure 3:
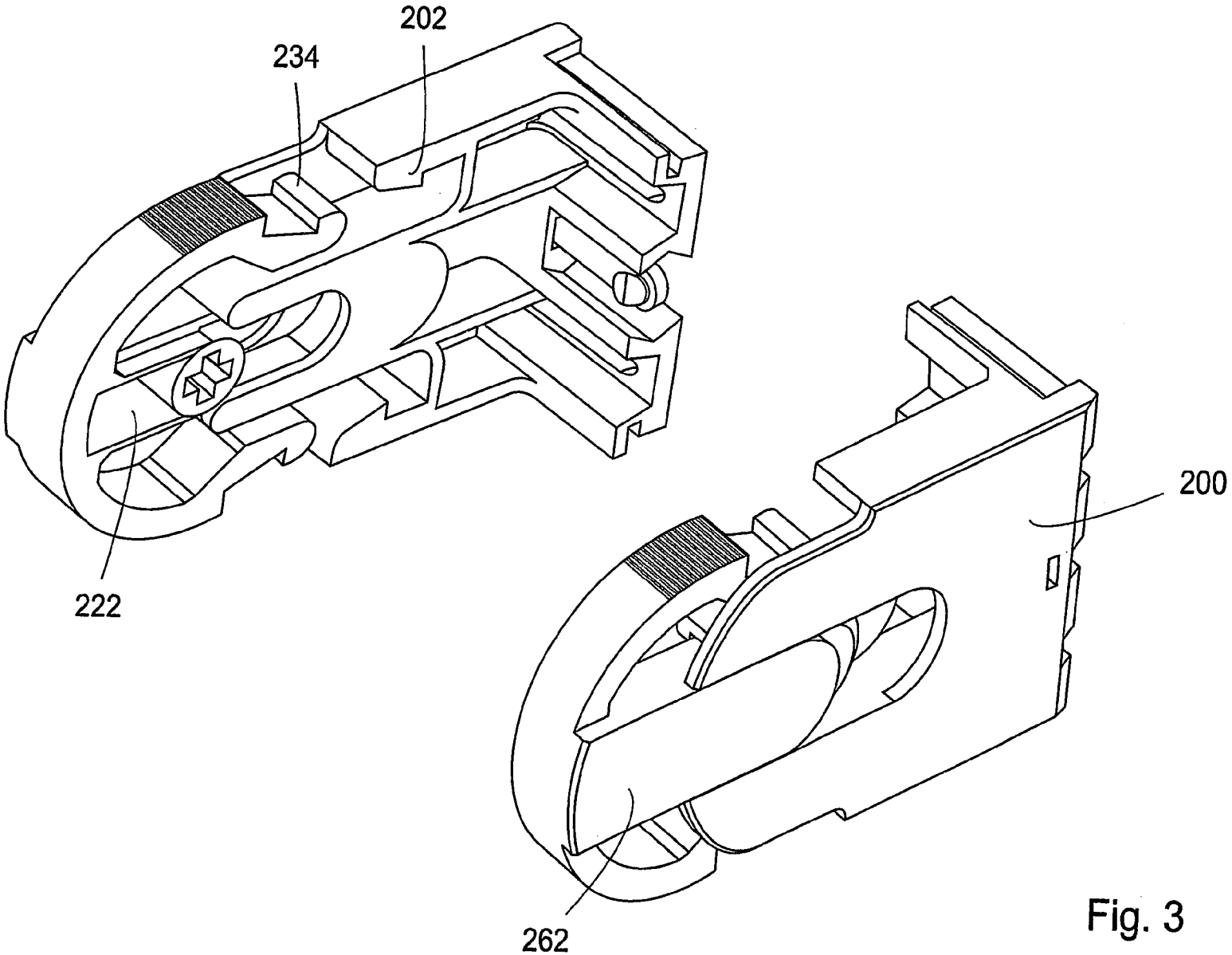
FIG. 3 shows the roller blind fittings of FIG. 2, partly assembled.

FIG. 3 shows a set of fittings where the two fittings have been partially assembled. The drawing clearly indicates how the central body 222, 262 of the clip fits into the corresponding recess in the base part 200, 240, and how the catches 234 and 202 approach each other.

Figure 4:
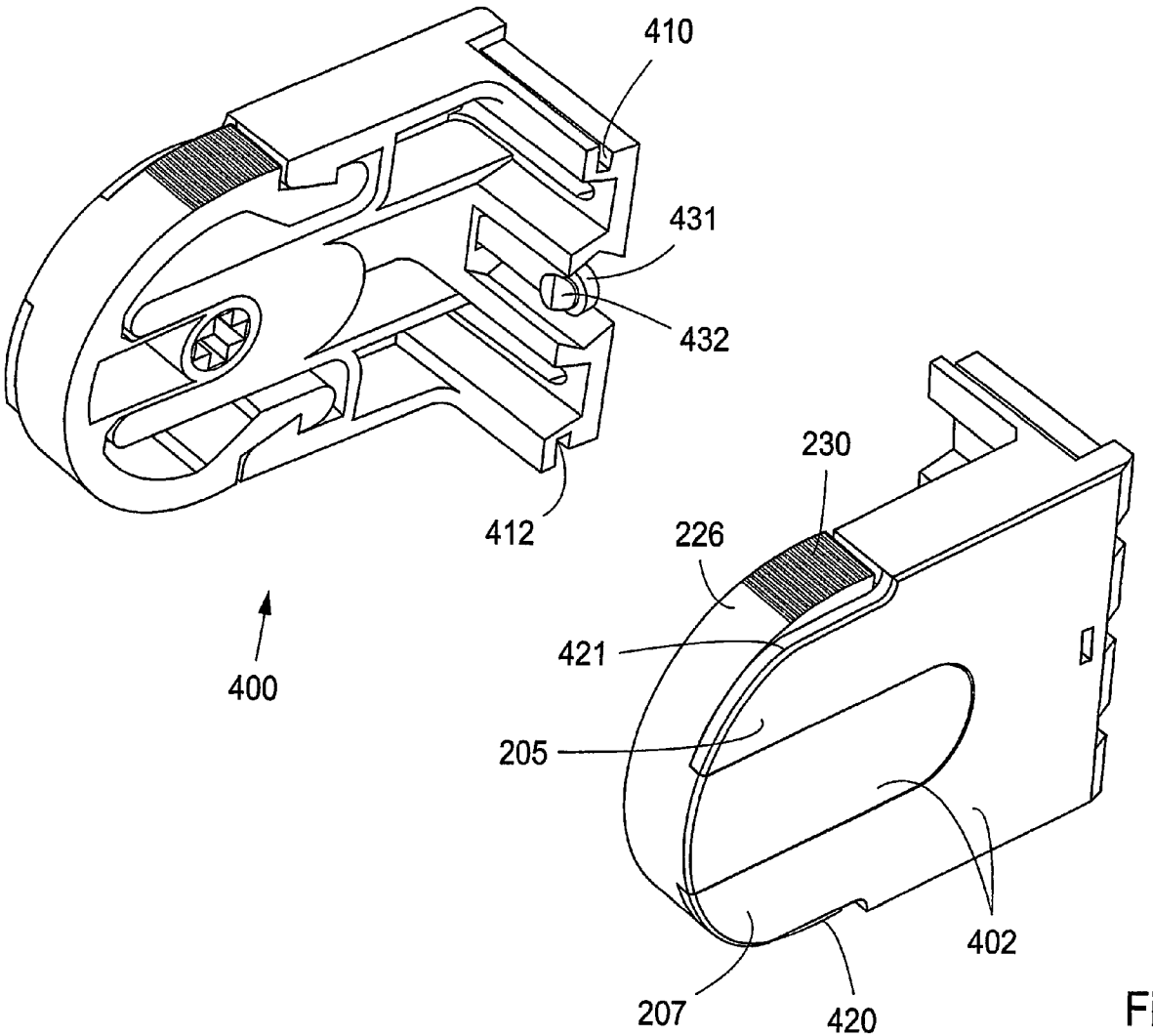
FIG. 4 shows the roller blind fittings of FIGS. 2 and 3, fully assembled.

FIG. 4 shows the fittings fully assembled, the assembled unit being essentially smooth on the surface facing away from the blind. Near the grip area, the edges 420, 421 of the external supporting panels 205, 207 of the base part are shaped to make the external profile of the base part smaller than that of the resilient arms 226, 228, when these are not compressed. When the arms are to be compressed, i.e. when the catch 234 is to be disengaged, the fingers of the disengaging person are thus allowed to carry out the compression without being impeded by the external profile of the base part. Put in other words, the edge of the base part 240 is provided with cut-outs, which when the bracket is assembled facilitate the compression of the resilient arms 226, 228. The drawing also shows that the base part is provided with grooves 410, 412, enabling the attachment of the bracket to a mounting rail or the like, without the use of tools. The base part is also provided with a resilient lug 431, 650, having a first and a second peg at its outer end, one on each side. The first peg, the one facing the mounting surface (not visible in the drawing), is adapted to snap into a recess in a mounting rail, to keep the bracket from moving sideways in the rail (see FIG. 6). The resilient lug 431 and the grooves 410, 412, plus the second peg 432, can also be used to attach various auxiliary equipment to the bracket, such as a cord guide or a winding stop, when mounting the bracket to the rail.

Advantageously, a cassette may be attached to the fittings, using special fixtures in the form of grooves, holes or lugs. Such a cassette protects the blind all along its top side and front, but leaves a slot open downwards, through which the fabric of the blind will run when in use. The cassette can also improve the visual appearance of the roller blind as a whole, in particular when the blind is fully raised.

Figure 5:
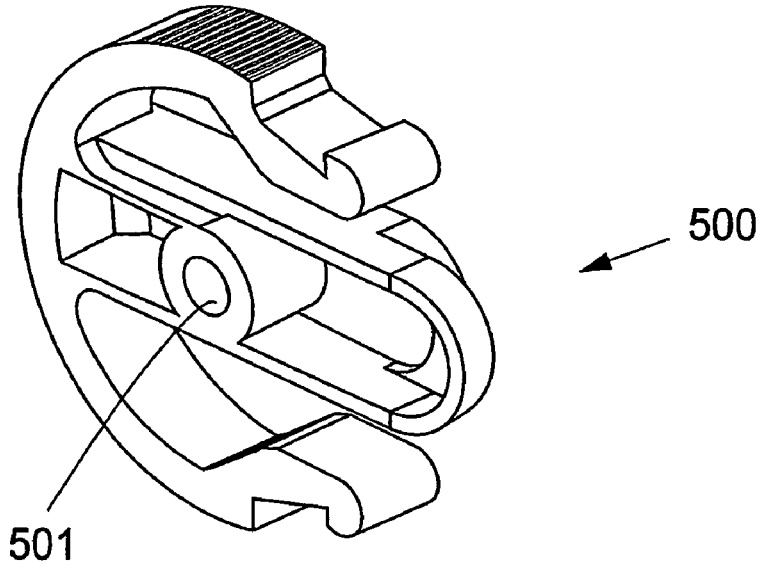
FIG. 5 shows two clips from disassemblable roller blind fittings according to the invention.
Figure 5:
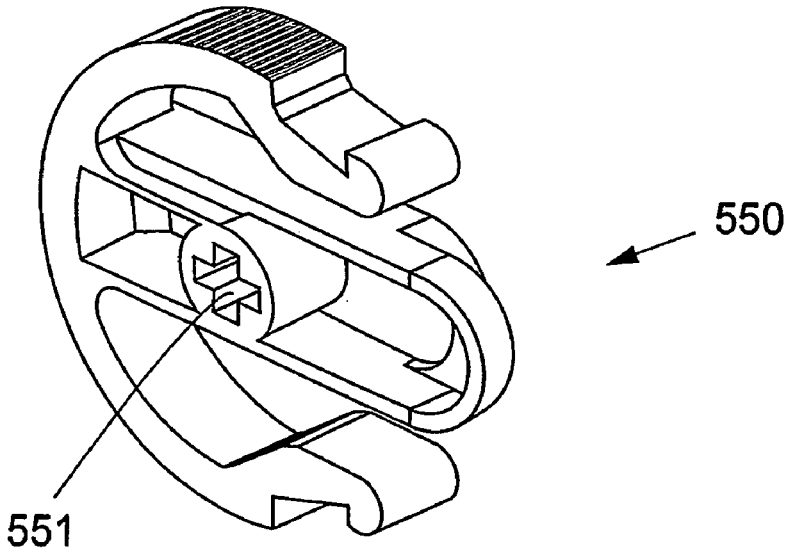

FIG. 5 shows two clips 500, 550 according to the invention, having receptacles 501, 551 adapted to receive the cylindrical and the torque-transmitting roller pins, respectively.

Figure 6:
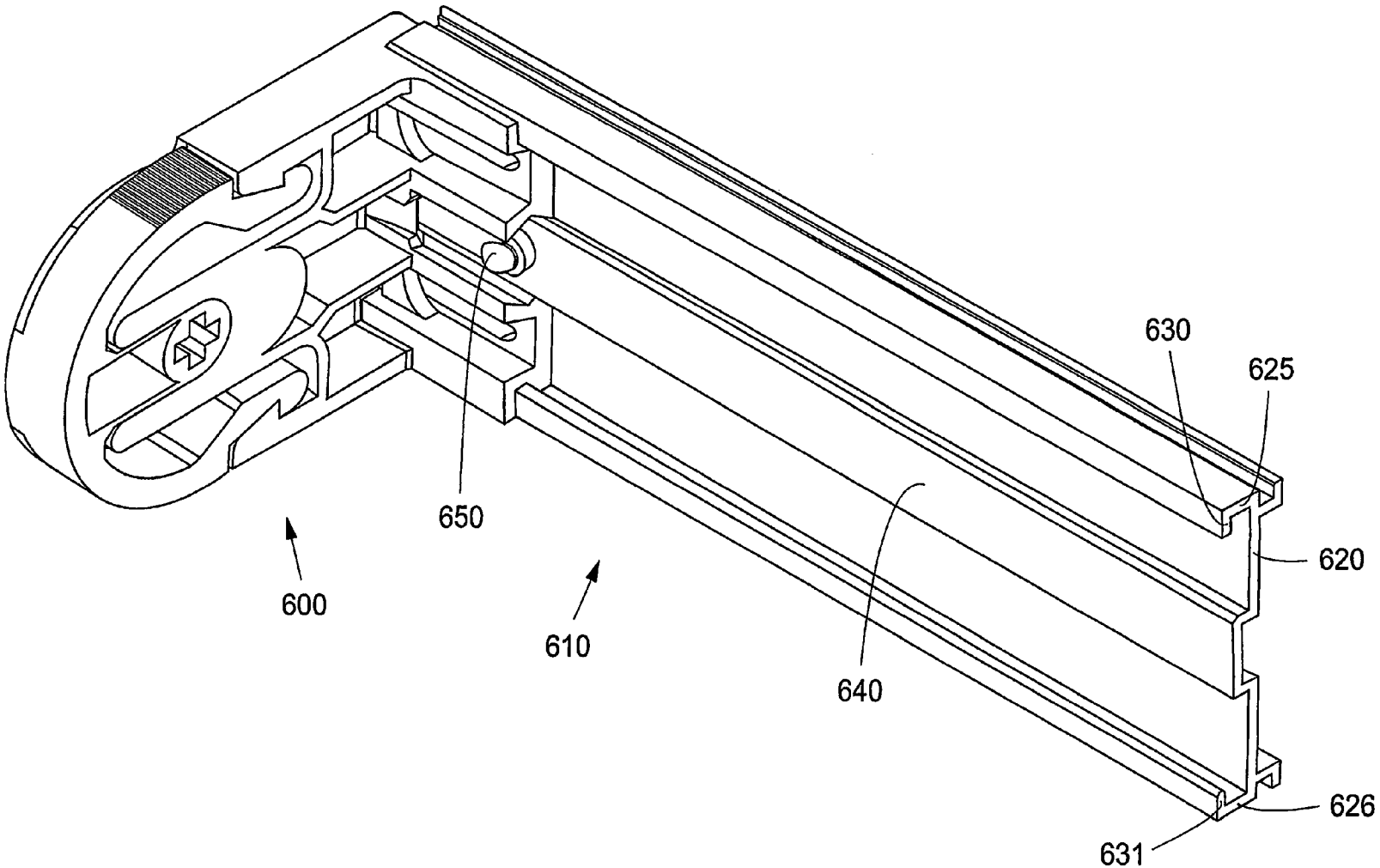
FIG. 6 shows a bracket, attached to a corresponding mounting rail.

FIG. 6 shows a bracket 600, attached to a mounting rail 610. The profile 620 of the rail 610 comprises a base section 620, side sections 625, 626 and flanges 630, 631, adapted to interact with structures 410, 412 of corresponding shapes belonging to the bracket 400, 600, with a frictional fit. In addition, the fittings are kept in place by a locking mechanism comprising a resilient lug 650, provided with the said first peg, which enters a hole in the central face 640 of the rail. The bracket 400, 600 may be fitted to the rail without the use of tools. To dismount the bracket 600 from the mounting rail 610, only a simple tool is necessary, to press the first peg on the resilient lug 650 out of the central face 640 of the rail.

The invention claimed is:

1. A set of roller blind fittings, the set comprising a first and a second roller blind bracket, where at least one of the brackets comprises a clip, provided with a receptacle that is adapted to receive a pin at the end of the roller of a roller blind, and a base part, provided with an attachment for attaching the base part directly or indirectly to a surface, the clip and the base part being of a design that permits them to be assembled and disassembled, where said clip is provided with a central body, which in turn is provided with at least one resilient arm having a catch, and where said resilient arm has a far end and a fixed end, where the fixed end is fixed to the end of the central body facing away from the base part, and where the resilient arm extends in a direction towards the base part.

2. Set according to claim 1, wherein the resilient arm is provided with a grip area.

3. Set according to claim 2, wherein the grip area is located closer to a far end of the resilient arm than to a fixed end.

4. Set according to claim 1, wherein the bracket is provided with a cut-out, which when the bracket is assembled makes it easier for a person's fingers to access and operate a snap lock mechanism provided between the clip and the base part.

5. Set according to claim 1, wherein one of the brackets is provided with said clip, which is adapted to receive a round journal pin of the roller of a roller blind, and the other bracket is provided with said clip, which is adapted to receive a torque-transmitting pin of said roller.

6. Set according to claim 1, wherein the set is made of plastic.

7. Set according to claim 1, wherein the resilient arm is provided with a catch at a far end of the resilient arm.

8. Set according to claim 1, wherein the resilient arm is curved.

9. A base part useful for the fitting of roller blinds, the base part comprising an attachment part for facilitating the attachment of the base part to a surface, where said base part comprises an assembly part for assembly and disassembly in relation to a clip part, without the use of tools, and where said bass part comprises a receiving part for receiving a clip, where said clip is provided with a central body, which in turn is provided with at least one resilient arm having a catch, and where said resilient arm has a far end and a fixed end, where the fixed end is fixed to the end of the central body facing away from the base part, and where the resilient arm extends in a direction towards the base part.

10. Base part according to claim 9, wherein the receptacle comprises external supporting panels, adapted to support and guide all or part of the said clip part, in particular the resilient arm, where applicable.

11. Base part according to claim 9, wherein the base part comprises a rail attachment part for being attached to a rail without the use of tools.

12. Base part according to claim 10, wherein the attachment port comprises grooves and a resilient lug.

13. Base part according to claim 9, wherein the base part comprises a cut-out, which when the bracket is assembled makes it easier for a person's fingers to access and operate a snap lock mechanism provided between the clip and the base part.

14. Base part according to claim 9, wherein the base part comprises an attachment portion for attaching a winding stop to the base part, without the use of tools.

15. Base part according to claim 9, wherein the base part also comprises a cord guide attachment part for attaching a cord guide to the base part, without the use of tools.

16. A clip adapted to be used when fitting roller blinds, the clip comprising a receptacle for a roller pin, where the clip comprises an assembly for being assembled and disassembled in relation to a base part, without the use of tools, the base part being adapted to be attached directly or indirectly to a surface, and where said clip is provided with a central body, which in turn is provided with at least one resilient arm having a catch, and where said resilient arm has a far end and a fixed end, where the fixed end is fixed to the end of the central body facing away from the base part, and where the resilient arm extends in a direction towards the base part.

17. Clip according to claim 16, wherein the resilient arm is provided with a grip area.

18. Clip according to claim 16, wherein the clip is made of plastic.

19. Clip according to claim 16, wherein the resilient arm is curved.

* * * * *